US005862851A

United States Patent [19]

Stoebich et al.

[11] Patent Number: 5,862,851

[45] Date of Patent: Jan. 26, 1999

[54] CURTAIN ARRANGEMENT FOR PREVENTING SPREAD OF SMOKE

[76] Inventors: Jochen Stoebich, Kreuzallee 20a, 38685 Langelsheim-Wolfshagen; Stefan Siller, Katelnburgstr. 9, 38718 Seesen/Rhueden; Joachim Luther, Hessenstr. 1, 38690 Immenrode; Werner Schellenberger, Beibergstr. 17, 73441 Bopfingen; Thomas Wegener, Leipziger Str. 34, 04828 Bennewitz/b. Leipzig; Hansjuergen Linde, Heckenweg 47, 96450 Coburg; Reinhard Konrad, Heimatring 35d, 96450 Coburg; Michael Ciop, Schuetzenstr. 13, D-38690 Vienenburg, all of Germany

[21] Appl. No.: 620,942

[22] Filed: Mar. 22, 1996

[30] Foreign Application Priority Data

Mar. 22, 1995 [CH] Switzerland ..... 00815/95
Apr. 1, 1995 [DE] Germany ..... 195 12 355.7

[51] Int. Cl.[6] ..... E06B 9/08

[52] U.S. Cl. ..... 160/121.1; 160/23.1; 160/246; 160/120

[58] Field of Search ..... 160/120, 25, 121.1, 160/246, 247, 248, 249, 250, 251, 252, 253, 254, 255, 256, 257, 258, 259, 260, 261, 264, 265, 273.1, 310, 23.1

[56] References Cited

U.S. PATENT DOCUMENTS

| | | | |
|---|---|---|---|
| 1,243,923 | 10/1917 | Dargo | 160/323.1 X |
| 2,543,118 | 2/1951 | Maffei et al. | 160/23.1 |
| 3,583,465 | 6/1971 | Youngs et al. | 160/264 |
| 3,848,653 | 11/1974 | Youngs | 160/310 X |
| 3,900,063 | 8/1975 | Roller | 160/323.1 X |
| 4,453,584 | 6/1984 | Steele | 160/121.1 |
| 5,048,588 | 9/1991 | Weishar et al. | 160/310 X |
| 5,141,044 | 8/1992 | Hying et al. | 160/310 X |
| 5,195,594 | 3/1993 | Allen et al. . | |
| 5,271,448 | 12/1993 | Delgado | 160/271 X |
| 5,377,738 | 1/1995 | Cooper | 160/264 X |
| 5,477,902 | 12/1995 | Kraeutler | 160/264 X |

FOREIGN PATENT DOCUMENTS

| | | |
|---|---|---|
| 0572199 | 5/1993 | European Pat. Off. . |
| 1246626 | 9/1967 | United Kingdom . |
| 1492003 | 2/1976 | United Kingdom . |
| 2096222 | 10/1982 | United Kingdom . |
| 2108839 | 10/1982 | United Kingdom . |

*Primary Examiner*—David M. Purol
*Attorney, Agent, or Firm*—McAulay Nissen Goldberg Kiel & Hand, LLP

[57] ABSTRACT

A curtain consists of a web of temperature resistant material forming a web surface and may be unwound from a coil arranged on a coil core. The coil is supported by a bearing arrangement including at least one supporting surface so that the coil core, at least on one of its ends, is supported adjustably in height within a guidance. Alternatively or in combination, the curtain is guided by lateral guide bars including an arrangement for preventing the inserted curtain edge to be drawn out. Another feature is that at least two curtain webs the surfaces of which face each other have a common end bar forming a weight for the curtain.

19 Claims, 8 Drawing Sheets

CURTAIN ARRANGEMENT FOR PREVENTING SPREAD OF SMOKE

FIELD OF THE INVENTION

The invention relates to a curtain comprising a web of temperature resistant material forming a web surface and having lateral edge regions on either side, which web may be wound onto and unwound from a coil arranged on a coil core having two ends and being supported by a bearing arrangement including at least one supporting surface. If, in this context, the term "temperature resistant" is used, the degree of any temperature resistance will depend also on the other fire protection measures discussed later in connection with the curtain, which can render a higher degree of temperature resistance superfluous.

BACKGROUND OF THE INVENTION

In case of a fire, a dangerous element is constituted by the flames and the relatively high temperatures themselves. Simultaneously, there is also another potential danger from developing fumes or smoke having, certainly, also a higher temperature which, however, will not be as high as that of the blaze's source. This smoke, which, due to its higher temperature, will generally pass through the upper regions of a room, has the tendency to spread in large rooms and to cool down on cooler walls. Then it will fill also the lower regions of the room so as to deprive people, and animals as well, of breath.

Therefore, an endeavor has to be to prevent the smoke from spreading and to draw it off in such a manner that it no longer constitutes a hazard for breathing air in lower regions of a room. Admittedly, an arrangement to provide surfaces for drawing off or blocking the smoke is difficult, because such surfaces should not obstruct the normal use of a room.

From DE-A-23 38 352, a curtain with the characteristics of the introductory part of claim 1 is known by which draw off surfaces without any obstruction are provided, such surfaces being optionally adapted to shield against a blaze (fire-resistance). A disadvantage of this known attempt resides in that the curtains, by virtue of their support and by the arrangement of loose webs which are movable relatively to each other, are difficult to maintain in tight condition so that they do not result in effectively drawing off or shielding in case of a fire with the resulting air current developing thereby.

SUMMARY OF THE INVENTION

Therefore, it is an object of the invention to provide a better and more secure guiding of the curtain, by which a deformation of the curtain in the manner of a wind-blown sail or forcing it out of its position by a strong air current is avoided. According to the invention, this object is achieved by designing the curtain with the coil core, at least on one of its ends, being supported adjustably in height within a guidance and/or the curtain is guided by lateral guide bars including an arrangement for preventing the inserted curtain edge to be drawn out and/or that at least two curtain webs the surfaces of which face each other have a common end bar forming a weight for the curtain.

If one considers the support of the coil at the upper end of a curtain and the end bar at the lower end thereof as a guide, in the broadest sense of this term, the concept of the present invention consists in general terms in providing a guidance to at least one of the ends or edges of a curtain so as to maintain the curtain tight in a planar configuration without bulging or flapping even with a strong air current during a blaze. The temperature-resistive materials mentioned in the claim may be formed by thin metal sheets as well as by fabrics, particularly by woven clothing, made of temperature-resistive materials, preferably glass fibers, but also from carbon fibers, polycarbon fibers or ceramic fibers. A preferred embodiment will be described later.

The problem with large widths of a web resides, of course, in the coil core's bending. Since, however, the curtain will suitably be uninterrupted and continuous with adjacent mutually interconnected webs, the accommodation of an intermediate support is difficult, but is achieved by the invention.

A support will preferably be arranged at one of the edge regions, i.e. at those places where either two strips of web are situated edge by edge and/or where a free edge of the curtain is located. In this way, the web can be wound in a more tightened fashion resulting in less problems.

With the inventive design, it is easier to minimize or reduce actuation means for moving the curtain, i.e., only a single device will normally be necessary, e.g. a single motor rotating the coil.

For better guiding and for holding the curtain in a more tightened fashion, it is convenient to provide lateral guide bars, e.g. for large-area subdivision of a room by a curtain according to the invention.

In this way, a further problem can be under control. For the curtains are, of course, easily displaced out of their desired position by the air current developing during a fire, whereby sealing and proper draw off of fumes would no longer be ensured. This problem is especially avoided, if a gripping device is assigned to each guide bar ensuring that the curtain cannot slide out of the bars.

The end bar common to at least two curtain webs, whose surfaces face each other, prevents a relative movement of the webs under the air current of a blaze and results in a good guidance uniformly tightening both webs. Additionally, the advantage of a seal between the webs is achieved which opens up further possibility of fire protection, as will be discussed below.

By providing an intermediate support, bending of coil cores, in particular of those of great length, is avoided. By this optional support the necessity of providing a connection between adjacent strips of web is dispensed. Moreover, one can take advantage of a single drive.

BRIEF DESCRIPTION OF THE DRAWINGS

Further details and characteristics of the invention will become apparent from the following description of embodiments schematically illustrated in the drawings, in which.

DETAILED DESCRIPTION OF THE DRAWINGS

Figure 1:
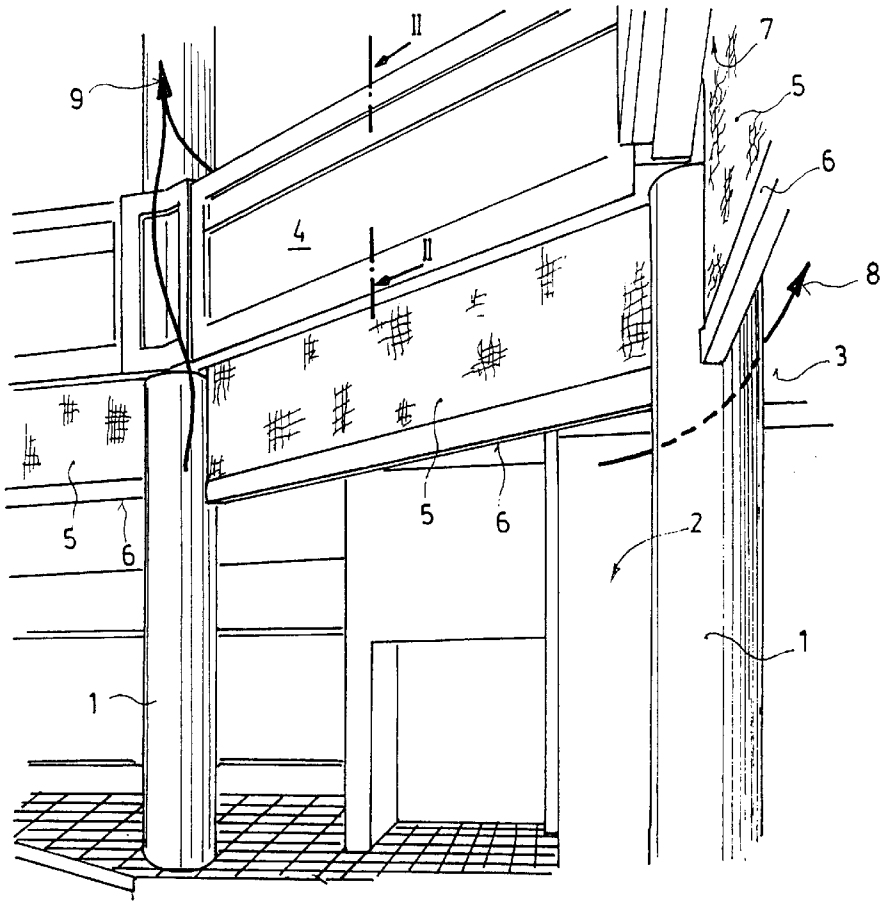
FIG. 1 shows a room equipped with a fume curtain.

FIG. 1 shows the interior of a building having at least two floors of the type usual for banking halls or shopping centers. For the admission of light, a glass structure (not shown in FIG. 1) rests on top of columns 1, the structure being provided with a flue flap meeting the rules for fire protection. In this way, the columns support the overarch of a kind of a domed hall, whereas the adjoining corridors 2 comprise a ceiling 3 on the level of the first floor. For these corridors 2, a separate flue is provided (not shown).

In the case of a fire, irrespective whether the fire breaks out in the area of the domed hall or in the area of the corridors surrounding this hall or in one of the adjacent rooms, it is the first requirement to prevent the smoke from spreading, e.g. from the corridors 2 into the domed hall where it cools and sinks down, thus, endangering breathing of the people which is present in the hall. Rather it should be ensured that the smoke is drawn off the shortest way.

To facilitate the drawing off of smoke, box-like casings 4 are installed around between the columns in the border region between the corridors 2 and the domed hall situated in front of them. These casings 4 house in their interior a coil 12 of a smoke curtain 5 which can be lowered, if necessary, in the manner shown in FIG. 1. Curtains 5 are provided with lower end bars 6 which serve as a tightening weight when the curtains are unwound into their operative or use position, while closing a slot 7 in a storage position of the curtains which slot forms the exit for the curtain 5.

The curtain 5 consists suitably of a noninflammable woven fabric, for example of glass fibers, carbon fibers, polycarbon fibers or ceramic fibers, optionally in combination also with one of the other type of fibers mentioned above which can also be used. If desired, the curtains may also comprise a noninflammable impregnation and/or coating. Another embodiment which is preferably used for fire protection will be discussed below.

It is not necessary under all circumstances to lower the curtains fully to the bottom, because the hot fumes will pass along the ceiling and will be drawn off in the corridors in the direction of arrow 8, while in the domed hall it is, for example, drawn upwardly along the arrow 9.

It can be seen that the distance between the columns 1 is relative large and can amount to several meters. Since a normal width of woven fabric is not sufficient in some cases and expensive large width looms had to be used, it is possible to arrange for several fabrics of smaller width adjacent and partially overlapping each other to be unwound each from a coil core supported within the casing 4. This leads, however, to an expensive construction, because each coil core must have its own drive, and the drives have to be mutually synchronized. For this reason, such a design is adapted for rather smaller rooms.

In order to provide a simpler construction for larger rooms, as of the type shown in FIG. 1, it is preferred within the scope of the present invention if the individual strips of curtain web are interconnected, for example by sewing the edges in the form of a butt joint or of an overlapping joint of fabric edges. In this case, however, a coil core is necessary which extends over the whole length of the casing 4, and, thus, some problems with supporting the coil will arise, since bending of the coil core and obstruction when unwinding the curtains 5 from their upper inoperative position into their operative position shown should be avoided.

Figure 2:
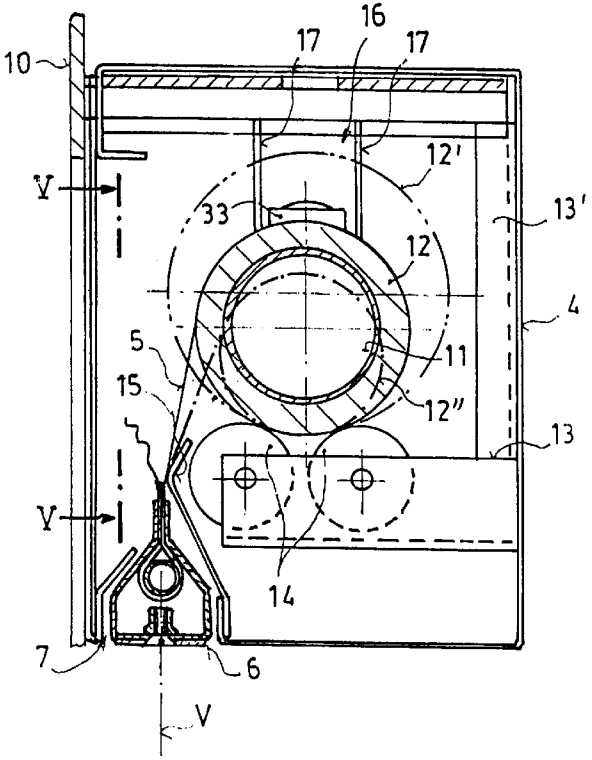
FIG. 2 is a cross-section along the line II—II of FIG. 1.

This supporting problem may be overcome by an arrangement as shown in FIG. 2. In this design, the casing 4 is fastened to a tiling 10 of the building by means not shown but known per se. Within the casing 4, there is a coil core 11 onto which a coil 12 of a curtain 5 is wound. Also the end bar 6 mentioned above is shown.

The coil 12 is supported by a supporting arrangement preferably consisting of two supporting rollers 14 parallel to each other and rotatably mounted on two arms 13 (one only is visible) which project from one wall of the casing 4. The arms 13 are reinforced at the side of the casing wall by reinforcing ribs 13'. Theoretically, a single roller 14 beneath the coil 12 would be sufficient as it would also be possible to arrange a whole cage of several rollers around part of the circumference of the coil 12.

In this way, the coil 12 may be supported by pairs of supporting rollers 14 axially spaced from each other (the rollers of the pair being spaced in radial direction), although the coil as such, being continuous over its total length, would not allow otherwise for an intermediate support. Certainly, the consequence is that the coil 12, according to the unwinding length required and according to the length actually unwound, will assume different positions within the casing 4. Thus, the complete coil (i.e. the position corresponding to that of the end bar 6, as shown) will assume the position 12' represented in dash-dot-dotted lines whereas with unwound coil the core will assume the dash-dotted position 12". In order to ensure reliable unwinding, a draw off guide is preferably provided about in a vertical center plane V of slot 7, said guide being possibly formed by a draw off roller, but is preferably formed by a draw off edge 15, suitably being slightly resilient.

In order to enable a reliable movement of the core and the coil 12 up and down from position 12" to position 12' and vice-versa it is preferred to provide a vertical guidance in the form of a guiding slot 16 or a guiding bar, the slot, for example, being defined by two struts 17 of the casing 4. The construction within the region of this guiding slot 16 will be discussed in detail below when reference is made to FIG. 5.

Figure 3:
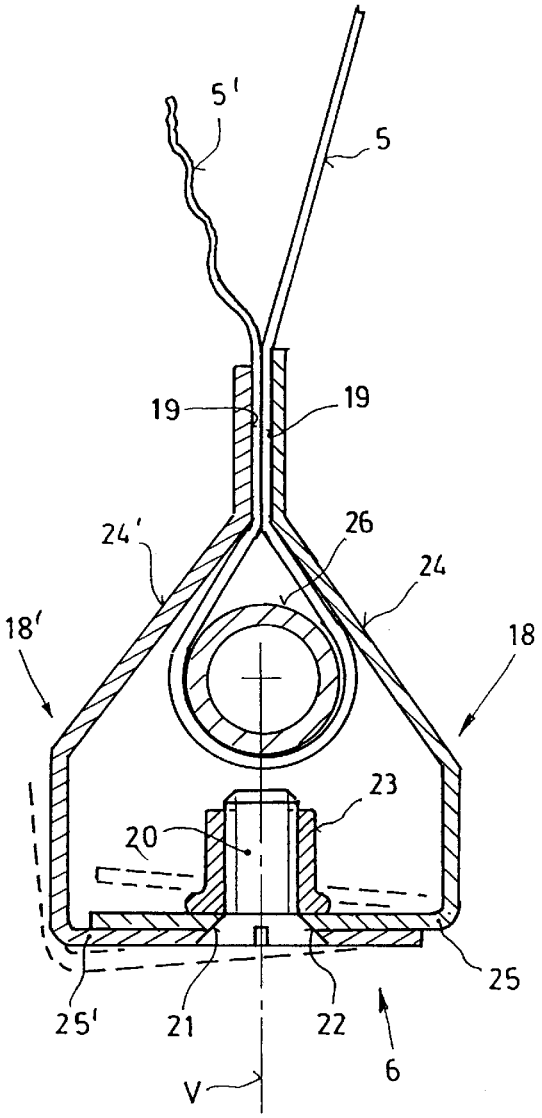
FIG. 3 is an enlarged view of a detail.

In FIG. 2, the above-mentioned end bar 6 is illustrated whose construction is shown in detail and at an enlarged scale in FIG. 3. As has already been mentioned, the purpose of this bar is among others to serve as a weight, but it is clear that tightening of the woven fabric securing such a large room, as in FIG. 1, is also of eminent importance to enable proper winding onto the core and that it is difficult to accomplish with such a large width of the curtain.

As shown in FIG. 3, the end bar 6 consists of two bar legs 18 and 18' which, for example, could be integrally and resiliently formed, but in the embodiment illustrated are constructed as separate parts to facilitate handling. This also makes it easier to achieve a modular construction by combining the separate parts 18, 18' off-set over a desired length, thus achieving great stability without the need for additional connection parts. Each of these bar legs 18 and 18' has a clamping surface 19 at its free end, the two clamping surfaces 19 preferably being parallel to each other in the clamping position, as shown, in order to distribute the clamping force over a larger area. As will become apparent, it is preferred if the two clamping surfaces 19 are formed as smooth surfaces, although it would be theoretically possible to provide them with projections, such as teeth, biting into the fabric of curtain 5.

The purpose of this preferred construction to suitably enable an adjustment in length after clamping the end of the curtain wherein portions of the curtain which form wrinkles may be drawn deeper into the end bar, while too tightened portions are redrawn. This will be facilitated if clamping is achieved purely by friction so that drawing of individual curtain portions is rendered possible.

Actuation of the clamping device is effected in such a manner that the bar legs 18 and 18' first take an open position indicated by interrupted lines. In this position, a clamping bolt 20 is not yet screwed tightly into aligned bores 21, 22 of overlapping connection cross-pieces 25, 25' and in a clamping socket or nut 23 shown in FIG. 3, i.e. a desired length of the curtain 5 may be inserted between the two bar legs 18, 18' and their clamping surfaces 19 being open now. Then, with screwing the clamping bolt 20 in, the two clamping surfaces 19 approach each other and hold firmly the clamped portion of the curtain 5. The clamping socket or nut 23 may be formed as a separate part or may be rigidly secured to the connection cross-piece 25 of the bar leg 18. In particular, it is a riveted nut.

Preferably the design is such that at least one of the two bar legs 18, 18', particularly both, comprise each an inclined portion 24, 24' which forms an angle with the vertical center plane V mentioned above, the two inclined portions 24, 24' forming a kind of wedge. Suitably, a clamp piece 26 is inserted in that wedge which is preferably rounded in a rod-like manner and has particularly a circular cross-section.

As may be seen in FIG. 3, the end of the curtain can be wrapped around the clamp piece 26, and then protrudes as end 5' outside the clamping surfaces 19. Due to the smooth form of the clamping surfaces 19 and the rounded peripheral surface of the clamp piece, it is easy to balance the tension of the curtain under the weight of the end bar 6 by drawing the free end 5' or the curtain before tightening the clamping bolt 20 so that the curtain in its lower, operative position (cf. FIG. 1) is uniformly tensioned over its entire width. In this situation, a clamping action will result between the clamp piece 26 and the inner surfaces of the inclined portions 24, 24' forming an inner wedge. Only when a balance of tension is attained which ensures winding of the curtain 5 onto the coil 12 without wrinkles (cf. FIG. 2), the clamping bolt will be finally tightened so that the bar legs 18, 18' assume their position shown in full lines in FIG. 3. In accordance with the application, the clamp piece 26 may have less or more weight and, thus, will also act as a load element.

Figure 4:
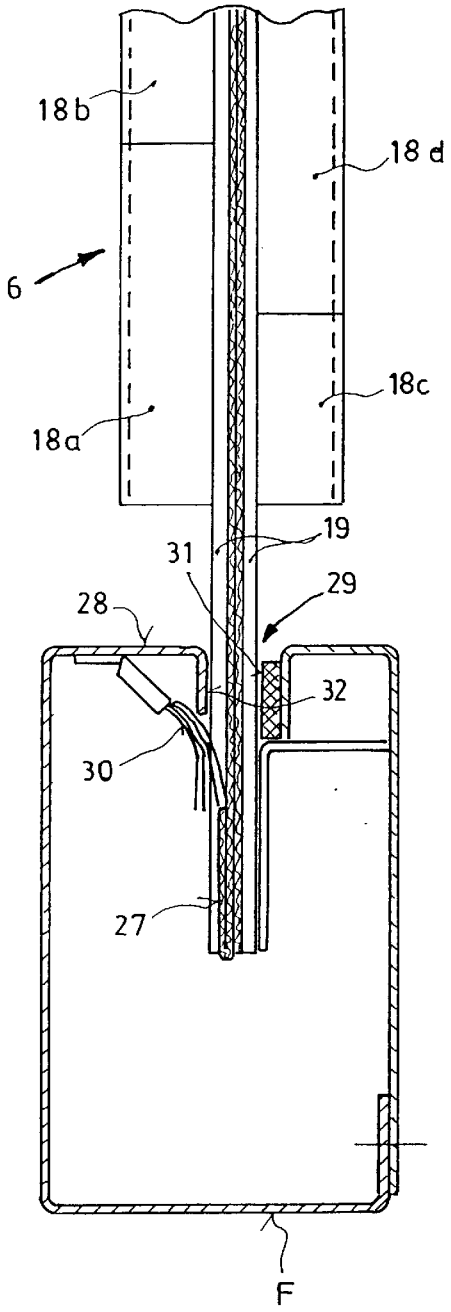
FIG. 4 is a cross-section through a lateral guide bar for a curtain

It has already been mentioned above that it is, in principle, possible to accommodate individual webs of curtains either in an adjacent position or overlapping each other onto separate coil cores. In such a case, however, a tight lateral closure will not be attained. Although this will at first lead to only a relatively small slot-like opening (which nevertheless has to be taken into account), but will result in bulging of the curtain by the air current arising in the case of a blaze. This will displace the curtain out of its vertical position so that its function as a guide for fumes or as a barrier against the fire will be called into question. It is true that the above-mentioned weight of the end bar 6 has a stabilizing effect, but still a further improvement may be provided within the scope of the invention (but also independently from the movable support of the coil 12 or the construction of the end bar) by guiding or sealing the border edges of the curtain 5 composed of several (or at least two) webs of fabric within (in the arrangement of FIG. 1) substantially vertically extending guide rails or bars comprising a holding device. A first embodiment of such a guide bar is shown in FIG. 4.

In this embodiment, the curtain 5, which besides could consist of one or more webs commonly wound around a core, suitably has an edge 27 turned up and sewed forming a reinforcement of the fabric web at this location. This edge area of the curtain 5 extends into a guide bar F which substantially is formed as a so-called "open surface box section" as shown, i.e. it is a box section one surface 28 of which is open to form a slot 29 in the longitudinal direction.

Within the region of this slot 29, preferably at least one of two devices are arranged which serve for tightening the curtain (to avoid bulging under the air current of a blaze), on the one hand, and for sealing (to avoid permeable gaps), on the other hand. One of these devices is formed by a sealing brush 30. In difference to the common arrangement being about perpendicular to a slot, however, the sealing brush is preferably obliquely inclined to the plane of the curtain 5 in such a manner that the ends of its bristles point against the edge area 27 of the curtain 5. This has two effects: First, the individual bristles brace themselves against small unevenness' provided by the curtain threads forming of the curtain surface, particularly against its warp threads, in the case that the curtain 5 is formed by a woven fabric, as is preferred. Second, if the edge 27 is thicker, as shown, the bristles' ends of the sealing brush 30 will brace also against this thicker edge and will provide a strong resistance given by their elasticity and their stiffness against drawing the curtain 5 out of the guide bar F, thus, virtually rendering impossible to draw the curtain out of the guide bar F.

A further arrangement for holding and sealing the curtain consists of a strip 31 of material which swells or expands under the effect of heat, e.g. a material being on the market under the trade name PROMASEAL. Preferably, a parallel abutment surface 32 defining the slot 29 is opposite this sealing strip 31. While the sealing strip 31 normally does not resist the movement of the curtain 5, it expands in case of a fire by the increased temperature and, thus, seals the slot 29 and holds the curtain 5 firmly pressed against the abutment surface 32. Also in this manner, the position of the curtain is stabilized in case of a fire. All the measures described up to now can be realized either separately or in common as well as also in combination with the embodiment described later with reference to FIGS. 6*a* and 6*b*.

In FIG. 4, it is indicated by interrupted lines how the legs 18 and 18' could be formed as modules of limited length. In such a construction, it is advantageous if, over the length of the end bar 6 (similarly to the alternate arrangement of webs 12*a* to 12*d* in the embodiment of FIG. 7 discussed later), alternately a module 18*a* of leg 18 is opposite each half section 18*c* and 18*d* each pertaining to another module of bar leg 18'. By this alternating arrangement, the opposite legs 18, 18' hold each other firmly so that a separate connection device can optionally be omitted. It may, however, be provided in a similar manner to that, as will be described for the casing 4 or 4 and 4' or also for the coil cores.

Figure 4A:
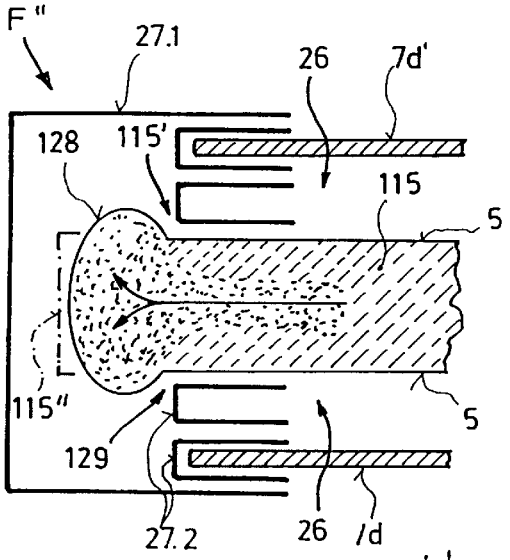
FIG. 4*a* illustrates an alternative embodiment.

In the case of FIG. 4*a*, a guide bar F" having approximately a U-shaped cross-section 27.1 into which, in the present embodiment, a pair of smaller profiles 27.2 are inserted on each side in such a manner that a slot or gap 129 is formed for receiving bar-shaped elements 115' of an inner layer 115 between two curtain webs 5. Instead of a pair of smaller profiles, a single one might be provided on either side, as is also conceivable that the profiles 27.2 situated adjacent the elements 115' serve for receiving additional layers or webs.

Normally, the elements 115' will form an about rectangular end edge 115", as is indicated in FIG. 4*a* by dash-dotted lines. However, material expanding under heat is preferably provided within an edge region 128, the material expanding the edge to the position shown in uninterrupted lines. Either at least the edge region of the elements 115' is enclosed by a flexible layer or hull, or outlet opening or even a slot is provided within the edge region between the two webs of the curtain 5 allowing exiting the swelling material so as to assume, for example, the position shown. In this way, the curtain, e.g. forming a fire protection, is firmly held in place in case of a fire and is not permitted to move out of its position under the influence of a developing air current, because the elements 115', which may be formed by fire-proof granular material or interconnected packages of it, can abut or prop with their lateral expanded rim against the back side of the profiles 27.2.

Figure 5:
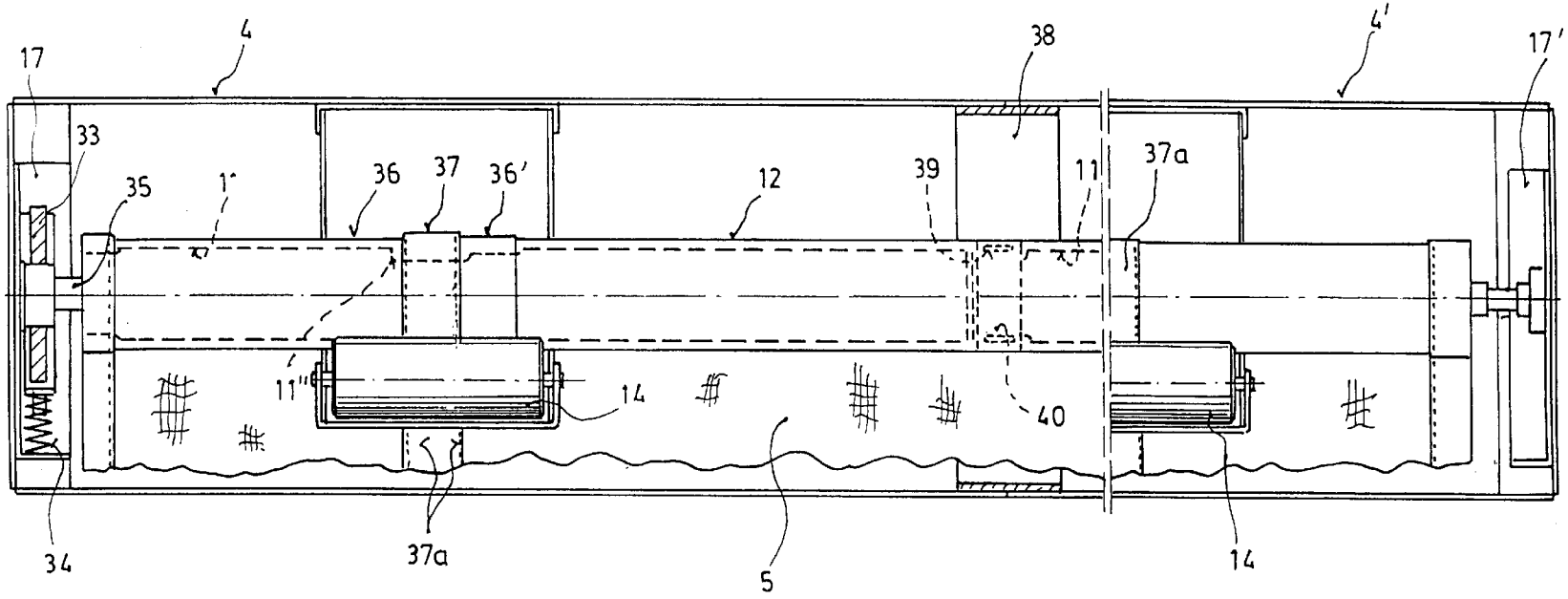
FIG. 5 is a view along the line V—V of FIG. 2.

In FIG. 5, a view along the line V—V of FIG. 2 is illustrated. In this figure, one of the struts 17 is shown guiding a supporting body 33 (only partially visible in FIG. 2). A similar strut 17' is provided at the opposite end of the coil core 11 (at right hand in FIG. 5). The supporting body 33, however, props on a resilient propping device, suitably in the form of a spring 34, as shown, so as to balance the weight of a motor for moving the curtain 5 up and down which is accommodated within the interior of the coil core at this location and, therefore, is not visible. This motor uses suitably the metallic coil core 11 as an external rotor which is provided with a series of permanent magnets in its interior, while the current supply lines for the centered stator are connected with a rigid axle 35, as is known for motors of the external rotor type. Instead of a spring 34, any other propping arrangement may be used, such as a balancing weight, a pneumatic spring or the like. Moreover, such a propping arrangement may be dispensable, if the weight of the coil 12 and of its coil core 11 is about uniform over their axial lengths, for example because a mechanic device is used for actuation and release of the curtain 5, as is known from rigid, generally plate-like fire shutters.

The above-mentioned motor may be of any kind. It may, however, be desirable to brake the downward movement of the curtain caused by the weight of the end bar after release, or even to be able to control it with respect to its speed. According to the invention it is more favorable to use an electric brake instead of the mechanical brakes employed heretofore. This can be done, for example, in such a manner that an eddy current brake is provided by a generator circuit of a DC motor, optionally of an AC motor instead (e.g. comprising condensers), i.e. that the motor is operated as a generator at least during lowering the respective curtain, but optionally is also switched this way during stopping. Thus, the curtain may normally be held by a mechanical stopping brake in its wound up condition. Only when a fire breaks out, the brake is released, for example by a fusing or melting holding device, after which the curtain is unwound by the weight of its end bar. During this movement, the motor is either switched into its generator mode, particularly continuously, or an appropriate pulse control is assigned to it, the pulse frequency determining the speed of the curtain. The motor is only operated in its prime mover mode to rise the curtain. It should be noted that such an electric brake is inventive independently from the type of support of the coil core or from the construction of the end and guide bars.

It has been mentioned that other arrangements for an electric brake are also conceivable. For example, the motor can be connected and controlled by a pulse supply circuit in which case the motor may be either formed as an asynchrone, a synchrone or even as a stepping motor. In the case of a DC motor, the pulses would have to be transformed into a corresponding DC current when operated in its prime mover mode. In this way, it is possible to predetermine exactly the rotational speed of the motor, and it is also possible to preselect a predetermined nominal speed and to control the pulse supply to meet this nominal speed, e.g. by means of rotational speed transducer connected either to the motor or to the coil core.

It may further be seen from FIG. 5 that the supporting rollers 14 are conveniently arranged where thickening of the coil 12 will occur by adjacent fabric webs due to overlapping edge regions 37. By this arrangement, tight winding onto the coil core 11 without any problem is ensured. These edge regions 37 may be interconnected by a connection arrangement, such as a series of clasps, preferably at least one seam 37*a*. Since the coil 12 is thickened by the overlapping edges, it may be advantageous to provide the coil core 11 in these regions 37 with a peripheral recess 11", as is indicated in FIG. 5 with interrupted lines.

Since the curtains according to the present invention should be used in buildings of various dimensions, it is favorable if the casing 4 and/or the coil core 11 and/or the end bar 6 is constructed of individual, substantially uniform modules which may be connected in the axial direction by appropriate connection means. In FIG. 5, for example, two casing modules 4 and 4' are put together in a butt joint and are interconnected by means of a connecting collar 38. Likewise, it is indicated that the portion of the coil core 11 which forms the external rotor of the drive motor has an opening 38 at its right end (with reference to FIG. 5) into which a coupling end 40 of restricted diameter of the adjacent coil core module 11' is inserted for common rotation.

Figure 6A:
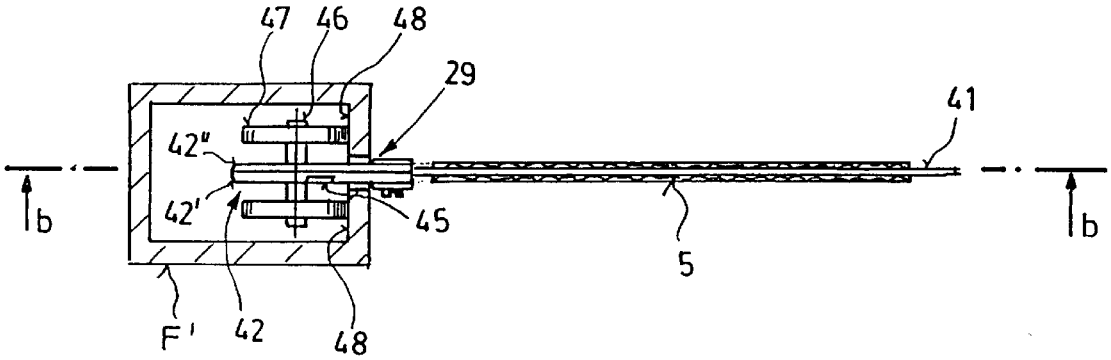
FIGS. 6*a* and 6*b* are alternative embodiments of a guide bar in a cross-section similar to FIG. 4 and in a lateral view.
Figure 6B:
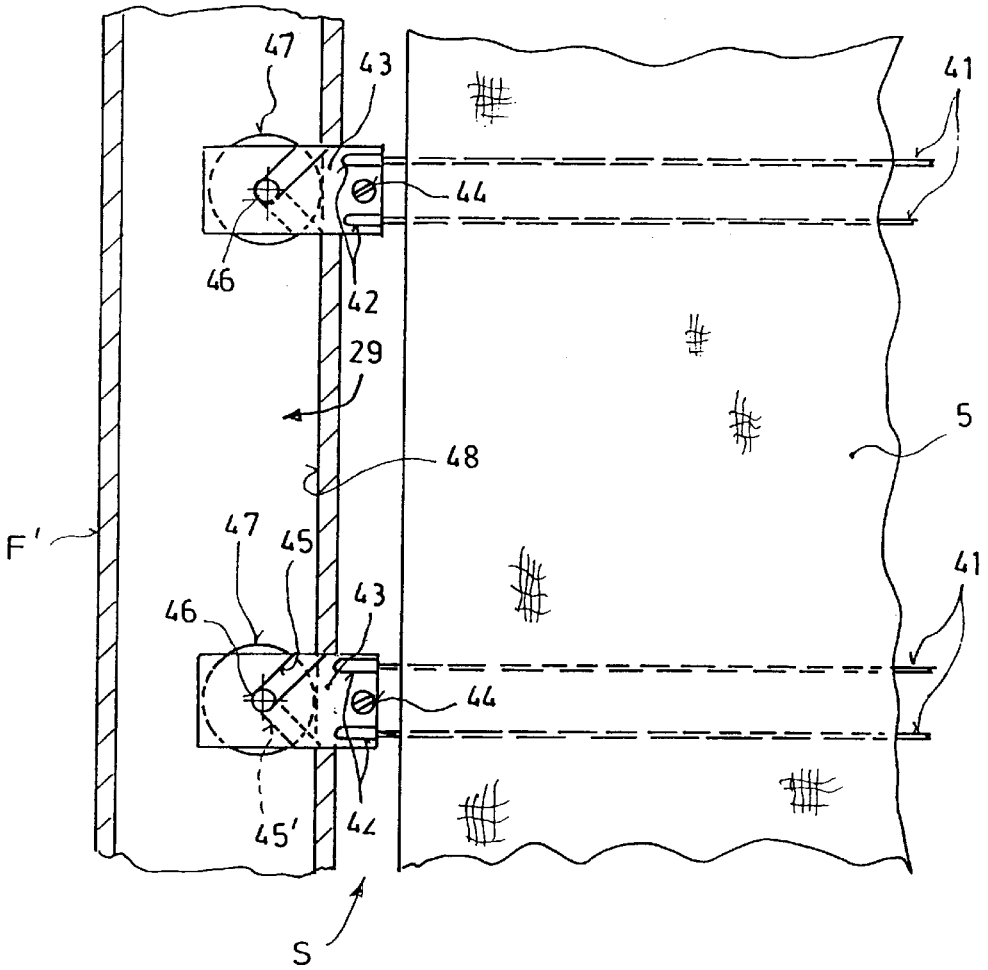

While FIG. 4 illustrates an embodiment of a guide bar F in which, for example, the sealing brush 30 is provided as an element elastically propping between guide bar F and curtain 5, such an element or a plurality thereof may also be formed in the manner shown in FIGS. 6*a* and 6*b*. According to this embodiment spring or tension elements 41 are incorporated into the curtain 5, e.g. sewed or woven in. These springy elements consist, for example, of elastic spring steel and are connected to a clamping plate 42 at their ends. As is especially clearly shown in FIG. 6*a,* the clamping plate 42 consists of two plate elements 42' and 42" having convexities 43 to define an elongate cavity in which a respective one of the springy wires 41 is received and is, for example, secured by a clamping screw 44. Such springy wires may consist of chromium steel and may have a reinforcing effect onto a woven fabric from a relatively low temperature melting material, such as glass, as will be explained later.

Both plate elements 42', 42" have, however, still another purpose. To wit, each of the plate elements is provided with an oblique bearing slot 45, 45', the inclination of these bearing slots being oriented in opposite directions so that one (45) opens at the upper edge of the pertaining plate element 42', while the other (45') opens at the lower edge of the pertaining plate element 42". The axle 46 of a roller 47 is now inserted in each of the bearing slots 45, 45', the inclination facilitating inserting under tension.

Also in this embodiment, the guide bar F' is formed as an open surface box section, thus providing a roll on surface or rail 48 for the rollers 47 on either side of the slot 29. It may be seen that in this way a small gap S remains between the guide bar and the edge of the curtain which, although being in general neglectable, may be covered by either a protruding wing of the guide bar F' or by arranging the roll on surface 48 farther in the interior of the box section which would result in two legs jutting out and covering the gap S on either side of the curtain 5. Moreover, this embodiment could be combined with that of FIG. 5, for example by realizing an arrangement of strip 31 and abutment surface 32. In addition, the sealing brush 30 may be provided if necessary in special applications. In any case the springy or tensioning wires 41 provide for a certain tension of the curtain 5 even in case of a strong air current.

Figure 7:
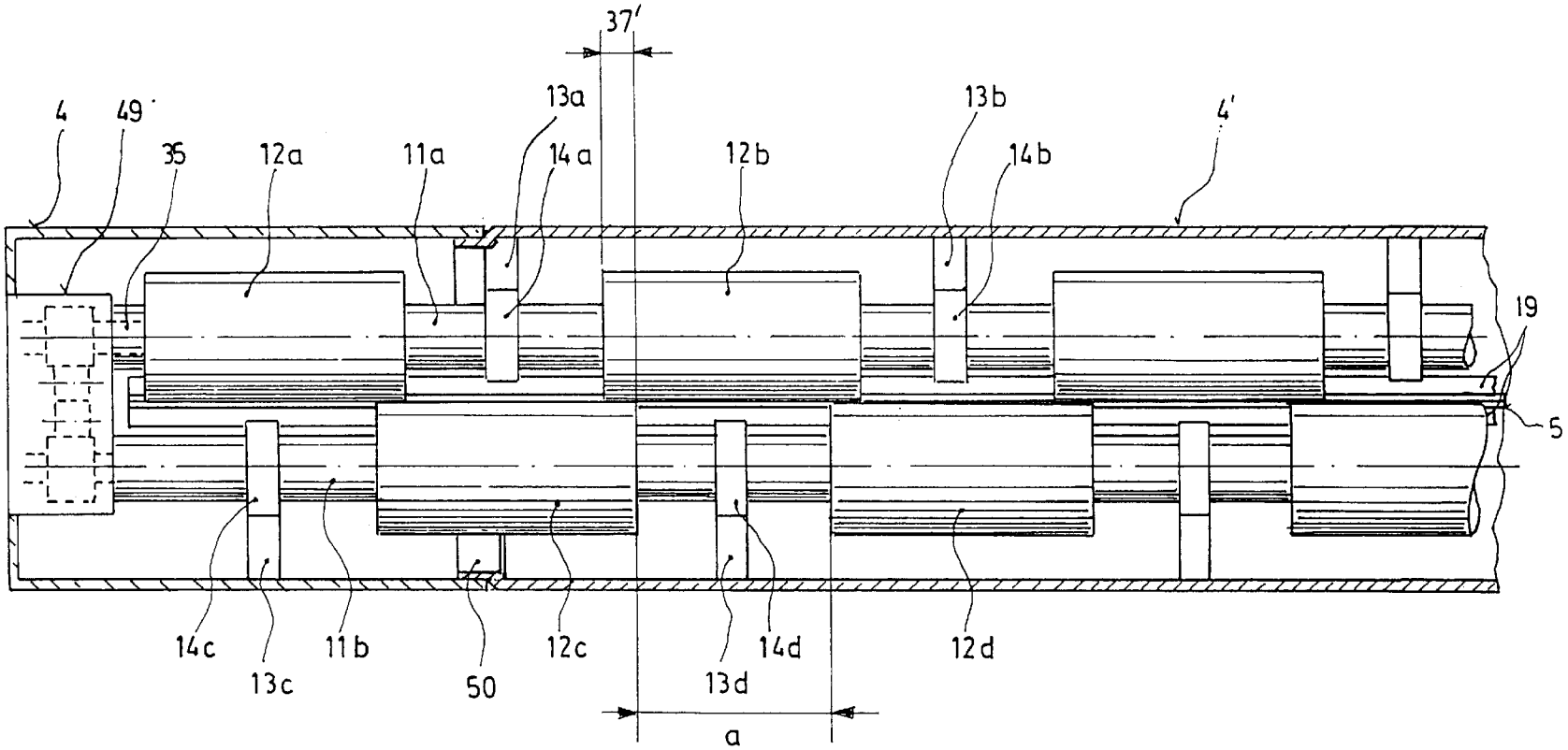
FIG. 7 is a plan view of a further embodiment of a curtain.

FIG. 7 shows an alternative embodiment to that discussed with reference to FIGS. 2 and 5. In this case, a pair of coil cores 11*a,* 11*b* are provided which extend throughout the whole length of the hall or room to be shut off. Each of the coil cores 11*a,* 11*b* has individual webs 12*a* to 12*d* wound in a distance a from each other, the distances being chosen in such a way that there is an overlapping edge region 17' at the edges of the webs 12*a* to 12*d*. In order to wind the webs 12*a* to 12*d* in the form of separated coils, the adjacent curtain webs are not interconnected in this embodiment.

Due to the distances a, there are portions of the coil cores 11*a,* 11*b* where the same are uncovered so that it is possible to accommodate intermediate bearings 14*a* to 14*d* connected to the casing 4, 4' through struts 13*a* to 13*d*. Suitably, the two coil cores 11*a,* 11*b* have a common drive within a gear box 49 (which, in contrast to the embodiment of FIGS. 2 and 5, can be connected to the casing module 4 in a stationary manner) in which the movement of the motor, having a stator 35, is transmitted by gear wheels, as is indicated in interrupted lines. Of course, the two coils 11*a,* 11*b* will rotate in opposite sense to each other. Such a common drive may be a nonelectric one, as already mentioned, and may, for example, be realized by means of a releasable weight in known manner (or may comprise the electric brake discussed above). Another embodiment could provide that the support arrangements of FIGS. 2 and 7 are combined, for example, the bearings 14*a* and 14*b* for one (11*a* or 11*b*) of the coil cores, the rollers 14 of FIG. 2 for the other one.

While the two coil cores 11*a,* 11*b* are relatively closely adjacent to each other, this is not necessary in each case, since with embodiments comprising a common outlet slot 7 the webs 12*a* to 12*d* will be combined in it. Moreover, reference is made to the embodiment of FIG. 12 described later. On the other hand, the foregoing embodiments have shown that the coil cores 11*a,* 11*b* within the casing 4 may be stationary in horizontal direction; this also is not forcibly necessary, because it would be possible that at least one of the coil cores is supported moveably against the other and is urged (pressed or drawn) against it by a biasing arrangement, such as a spring, in order to ensure tight engagement of the coil webs 12*a* and 12*b* with the webs 12*c* and 12*d*. In each case, any gap between the webs are reduced if a single end bar (as 6 in FIGS. 2 and 3) is common to all webs, thus tightening the free ends of those webs 12*a* to 12*d* and constituting a common, relatively large weight against movement by any air current. If desired, it is also possible to provide only part of the webs, for example the webs 12*a* and 12*c* facing each other, on the one hand, and 12*b* and 12*d* on the other hand, with a common end bar, but, in general, this will not add any advantage. Another means for reducing gaps are the above-mentioned guide bars.

As has already been explained above with reference to FIG. 5, a modular construction is of advantage also in this case. While the points of interconnection of individual modules of the coil cores 11*a,* 11*b* are not shown (they are covered by the coils 12*a* to 12*d* or by the bearings 13*a* to 13*d*), the joint between the casing modules 4, 4' may be seen as a mere non-limiting example. In this example, the joint is of the plug connection type in a similar way, as has been described with reference to the coil core modules 11, 11' of FIG. 5. The module 4' has a restricted connecting edge 50 to be plugged simply into the module 4. If desired, an additional connection by cementing, soldering, brazing or welding may be provided; it is further conceivable to prestress the individual modules by means of bracing elements, such as bracing wires so that dismounting is easier possible. For example for a large hall, a plurality of such modules (either of the casing and/or of the coil core and/or of the end guide) may be put together, the last one being fittingly cut. It is to be understood that the casing 4, 4' of FIG. 7, for the rest, will be constructed in analogous manner as represented in FIG. 2, although modifications are within the scope of the invention.

Furthermore, it is within the scope of the present invention to use other means as curtain webs instead of a fabric provided the material is temperature resistant and/or inflammable. A special embodiment will be described later.

For supporting the respective coil, a supporting arrangement 13, 14 having at least one supporting surface is provided. As a supporting surface a supporting roller, a supporting belt or even a slide surface may be used. In the case of a slide surface, friction should be as much reduced as possible to which end optionally an air cushion is employed.

Figure 8:
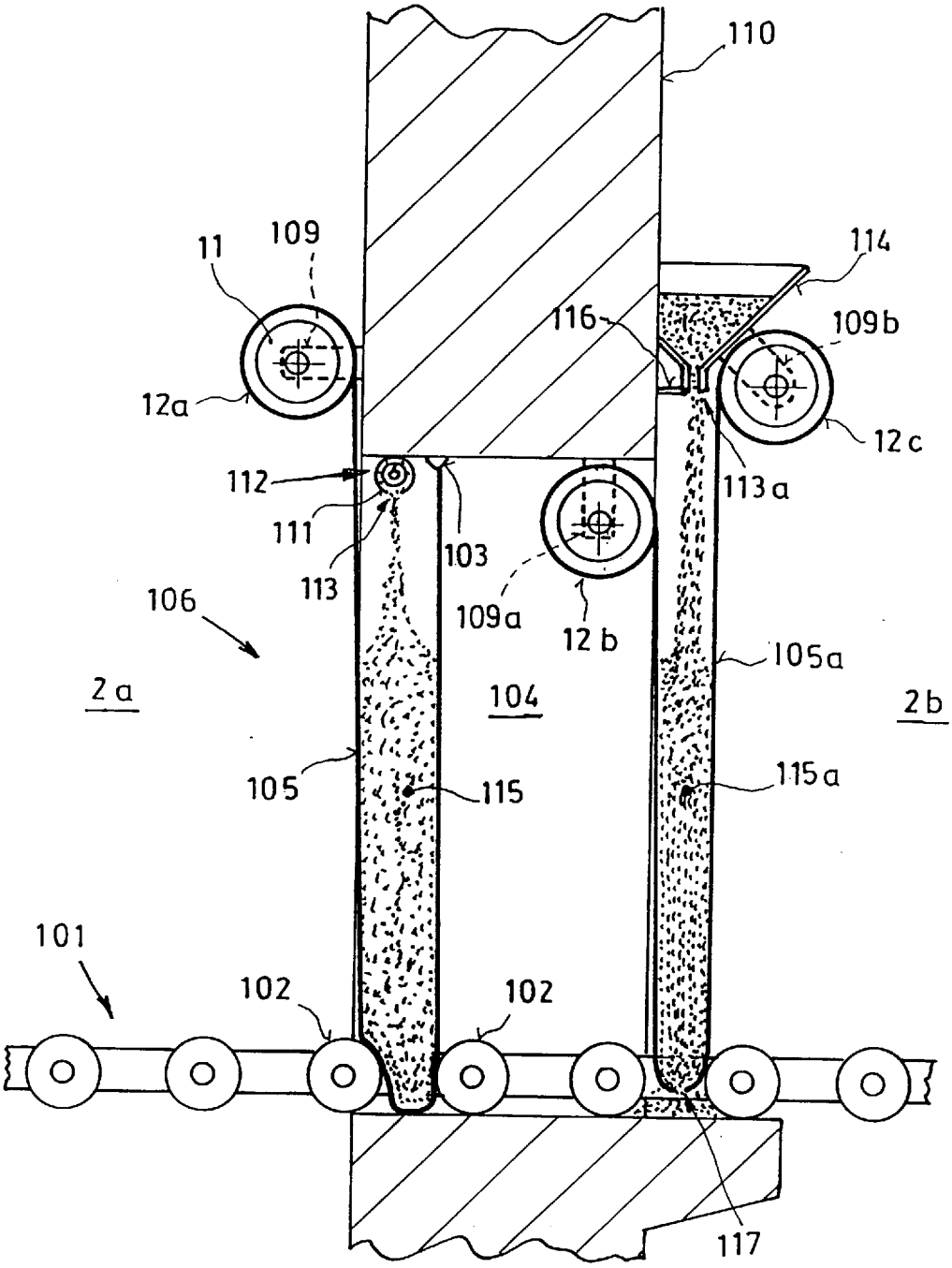
FIG. 8 represents a cross-sectional view of a wall separation having an opening to be closed in case of a fire, through which a roller conveyer extends, showing two embodiments of fire protection shutters according to the present invention.

In the case of FIG. 8, two rooms 2*a,* 2*b* are separated from each other by a wall 110, but are connected through an opening 104 of wall 110. A conveyor extends through the opening 104, the conveyor, in this embodiment being represented as a roller conveyor 101, but may be formed by any other conveyor, e.g. as a belt conveyor. It is clear that the opening 104 constitutes only a possible, non-limiting example of an application of a curtain according to the invention.

Although this conveyor 101 obstructs closing of the opening 104, this opening has to be shut off quickly and securely in the case of a fire. Known plate-like shutters have a relatively great mass even with relatively small openings (as the opening 104) for which reason it is necessary to provide brakes for their closing movement, the above-mentioned electric brake being a preferred embodiment. In this way, accidents and damages of piece goods or of the shutter itself are avoided However, by such brakes the speed of achieving closure will be limited.

This drawback is avoided by the embodiment shown on the left-hand side of FIG. 8 in that a fire protection shutter 106 for separating the rooms 2*a* and 2*b* consists of a fire protection curtain 105 (in contrast to the fume curtain discussed above) which has little mass and, therefore, can be quickly unwound from the coil 12*a*. This coil 12*a* is mounted on wall 110 by a bracket 109 indicated by interrupted lines and has a drive, e.g. a motoric drive in the manner explained above. It is also possible, however, to move the coil 12*a* by energy mechanically stored, e.g. by a weight or a spring or the like, as has also been discussed above. It is to be understood that the above described supporting arrangement may also be used instead of a bracket, but this will not be necessary with the ordinarily small widths of wall openings 104.

The flexible outer layer 105 (the curtain) will, in general, be formed by a fabric woven from glass fibers, carbon fibers, ceramic fibers, silicon fibers or polycarbon fibers, optionally from metal, such as thin metal sheet or wire, or of a combination of these materials. It has been found that it may be suitable to combine a material of lower melting point, e.g.

one listed above, with a material of higher melting point. If, for example, a layer of metal sheet covers a woven fabric, e.g. of glass, protection is achieved for the glass material which has a comparatively lower melting point, particularly not at last by the reflection of heat radiation into the burning room, but also by a mechanical reinforcement for even in case of melting (and the resulting caking) of the glass material, the metal sheet will hold it together.

For example, threads or wires of chromium material, such as chromium steel, have been proved to be especially suitable. Threads or wires of chromium steel may be woven in a fabric in more or less large distances, because they have to hold only the fabric together and to provide a sufficient strength when the material of lower melting point cakes. Distances of 0.2 to 3 cm (in warp and/or in weft) are realistic according to the respective application. Of course, the distance between the threads or wires is not limited in their lower values, but to higher values there are some resulting from temperature resistance and properties of the material of lower melting point as well as from the application of the curtain. Distances as high as 5 cm are, in fact, conceivable. Optionally, such a woven fabric may comprise a coating either of metal sheet or any other suitable material. Among others, a coating of polyurethane has been found advantageous, especially when exhibiting a certain reflectivity.

It may be seen that the outer layer 105, thus obtained, due to its flexibility, may easily conform to the shape of the rollers 102 of the roller conveyor 101, thus ensuring tight closing of the opening 104. It may further be seen that the curtain 105 is favorably formed as a loop for reasons still to be explained, where the right-hand end 103 of the loop in FIG. 8 may be fastened to the upper side of the opening 104.

The loop-shaped design enables insertion of fire-proof or fire resistant material into the loop in an especially favorable manner. This can be done either shortly after lowering the outer layer 105 or during it. In this way, the position of the lower end of the loop is, not at last, secured between the rollers 102, since a considerable air current may develop through the opening 104 in case of a fire. The fire-proof or fire resistant material introduced into the loop may be of any type, as will still become apparent from the following description, but a flowable material, such as a powdery or granular material, is preferred. Of course it would also be possible to move a fire-proof or fire resistant plate into the loop.

As a flowable material, water or another liquid could be sprayed into the loop. Although it is known to spray water on both sides of a curtain, the arrangement of such a spraying device in the interior of a double curtain results in a more effective use of sprayed liquid, while maintaining the advantage of a double closure of the opening 104. For, on the one hand, a single spraying arrangement is necessary only (instead of a double one), and on the other hand, this liquid will remain for a longer time within the hull formed by the curtain, thereby developing a longer cooling effect, while with increasing temperatures being expelled in the form of steam through the pores (in the case of a woven fabric) or openings of the curtain, thus cooling the outer surface, as will be explained later.

A special kind of such flowable material are fire protection foams or mineral foams which will either foam by an additive introduced into the loop or by the temperature of the blaze itself. In many cases, it may be convenient to admix various additives to such a foaming material. Thus, it may be advantageous to admix material which foams under the influence of heat just within the region of the rollers 102, because the interspace between the roller will be sealed in this way most effectively. Optionally, a swelling material, as discussed with reference to FIG. 4*a,* can be used either alone or in combination.

Another favorable additive may consist of a substance which reacts endothermically which removes heat by chemical transformation, thus cooling the fire shutter and imparting a longer resistance. An example of such a substance is zinc oxalate, but a series of substances having similar properties are conceivable. Furthermore, it is possible to add a solidifying binding agent, but optionally merely water. A further possibility in this connection will be discussed later with reference to FIG. 11. Other suitable additives may be antifreezing agents, for example if the rooms 2*a* or 2*b* are subjected to temperatures below the freezing point. In an environment endangered by corrosion, corrosion-proofing agents could be added, for example to preserve the curtain web or a hull provided for the fire-proof material incorporated. For example it would be possible to pack a bulk material into bags, which optionally are interconnected, and to introduce them, in case of a fire, between two curtain webs or to lower them on one side of a curtain (e.g. if only one is provided).

Introducing such materials into a loop may be effected in various ways. For example, the housing 111 of a screw conveyor 112 (or any other conveyor, such as the plunger of a plunger pump) may be provided on the upper surface defining the opening 104 may be provided. This housing 111 can have a plurality of outlet openings 113 axially distributed over its length at its bottom side. In the case of a liquid, such as water, connection via a valve to an appropriate source, such as the line system, may be sufficient instead of a special conveyor.

When a fire breaks out, the coil 12 a is first unwound and simultaneously or shortly after, the conveyor 11–13 is actuated, e.g. the screw 112 is rotated, so that fire protection material, such as powdery or granular material, is discharged into the loop of the curtain web through the openings 113, thus forming an inner layer 115. This material is supplied from a source not shown, such as a supply bin or a tank. Such a supply bin will be discussed later with reference to the embodiment shown on the right side of FIG. 8. It is clear, however, that the kind and construction of the conveyor is of no importance, and that also other types of conveyors may be used, for example chain conveyors of the Redler type.

The openings 113 may have uniform cross-sections over the axial length of the housing 111, or the openings can exhibit an increasing cross-section when starting from the above-mentioned supply bin. This would contribute to a more uniform distribution of the material within the loop of the curtain web 105. In the simplest case, a single opening 113, for instance in the middle of the width of the wall opening 104 (when measured in axial direction of the housing) may also be sufficient, in which case a more or less steep alluvial cone will form. Such an opening 113 needs not forcibly to be provided at the bottom side of the housing 111, but can also be laterally located (in particular in the case of liquids) or at the front side (in which case the housing will extend only over part of the width of the opening 104) Instead of a single conveyor 111–113, a plurality thereof may be provided, either in order to introduce a ready mixture of fire-proof or fire resistant material simultaneously at different locations, or by having at least part of the conveyors connected to at least one source of an additive discussed above.

Instead of the conveyor 111–113 extending in horizontal direction, as shown, one or more tubes for supplying fire protection material may be lowered from inside the wall 110 about simultaneously with the curtain. In this case, optionally a grid of at least two such conveyor tubes are provided which, for example will spray a fire protection liquid over the length and width of the curtain at different locations when a fire breaks out.

It has already been mentioned that the right-hand side of FIG. 8 shows an alternative embodiment. This refers, above all, to its modified construction, but it is easily possible to apply two or more curtains according to the present invention in a single wall opening 104, a variety of combinations of the embodiments described herein as well as of their individual features being, of course, possible. The reason for a difference in the construction of two curtains with surfaces which face each other can, for example, reside in a different danger of fire in the two rooms 2*a* and 2*b* so that one would provide a more effective fire protection towards the room of greater hazard.

If the free end 103 of the curtain 105 is fixed, as in the embodiment facing the room 2*a,* the lower end of the loop, thus formed, will move with only half the speed of rotation of the coil 12*a.* Since one is not limited with respect to this speed, this may be still faster than with braking the fire shutter.

If, however, a greater speed is to be achieved and the parallel portions of the loop should not move relatively to each other, it is preferred if both ends of the curtain are moveable, as in the previous embodiments. This needs not necessarily to be done by arranging two coils, but can also be effected in the manner discussed later with reference to FIG. 9.

In FIG. 8 (at right) both ends of the curtain 105*a* are wound each on a coil 12*b* and 12*c,* the coil 12*b* being mounted on a bracket 109*a* below the upper surface defining the wall opening 104, whereas the coil 12*c* is mounted by means of a bracket 109*b* on a supply bin 114. It has already been mentioned that there are various possibilities to unwind these coils, for example by means of a motor drive. These drives must not necessarily have the same speed, i.e. there is no need for a synchronization.

Between the coils 12*b* and 12*c,* the supply bin 114 for the material of the inner layer 115 is provided and discharges it trough the open cross-section of the discharge opening 113*a*, e.g. after opening a slider or valve 116 which is only schematically indicated. However, it would also be possible that the web of the curtain itself covers the discharge opening 113*a* in wound up condition of the two coils 12*b,* 12*c*, for example to prevent powdery or granular material from exiting. In the same manner as mentioned with reference to the previous embodiment, a plurality of supply bins 114 may be provided, e.g. distributed over the width of the wall opening 104.

A specialty of this embodiment is that at least one, preferably a series of outflow openings 117 are provided at the lower side of the curtain loop. This requires, of course, that these openings 117 will assume the position shown, i.e. the two coils 12*b,* 12*c* will, in general, be unwound with the same speed, although even in this embodiment it is not necessary. The respective opening 117 may be covered by a coating melting under elevated temperatures so that a sealing effect is only achieved after melting (or evaporating) of this coating. Analogously, the pores of a woven fabric, as described above, comprising a cooling agent exiting from the interior could be covered by a coating which melts under the heat of a blaze (thereby absorbing further heat), this being possible independently from the presence of the other characteristics of the invention and, thus, constituting an invention for its own.

The fire-proof or fire resistant material being discharged through the opening(s) 117 seals the space between adjacent rollers 102 and cools this area. The arrangement can also be such that at the beginning a material is filled into the loop of the curtain 105*a* which expands and swells under heat, particularly after being discharged through the outflow opening(s) 117, thus filling all spaces and gaps when expanding.

When in this connection the question is of a loop of the curtain 105 or 105*a,* one may ask what the arrangement may be at the lateral edges of the web. In fact, there is some possibility that fire protection material (liquid, foam, powdery or granular material) could leave the loop through lateral gaps. This, however, can be prevented by the guide bars already mentioned and/or by arranging the curtain closely to the wall of the opening 104, particularly by a guide bar according to FIG. 4*a*.

Figure 9:
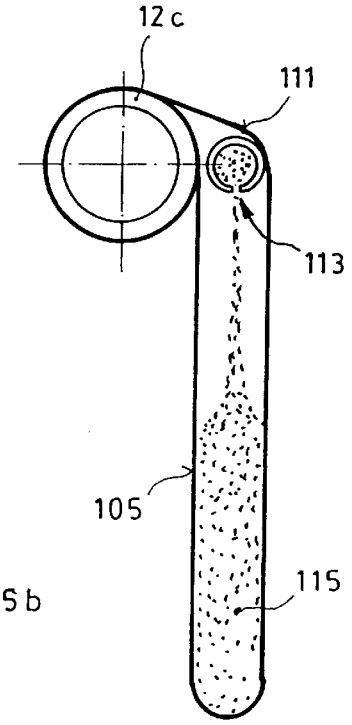
FIGS. 9 and 10 each illustrate a modified embodiment of a fire protection shutter.

Even if it has been stated that simultaneous unwinding both ends of a loop formed by a curtain accelerates closing of a wall opening, this must not necessarily be done with two (or more) separated coils 12*b,* 12*c*. FIG. 9 shows an approach where both ends of a curtain loop are wound up in two layers to form a common coil 12*c,* thus enabling common unwinding and achieving a more compact arrangement. The housing 111 of the conveyor for the fire protection agent serves, in this embodiment, also as a deflection means and as a spacer for the two parallel portions of the loop of the curtain 105.

Figure 10:
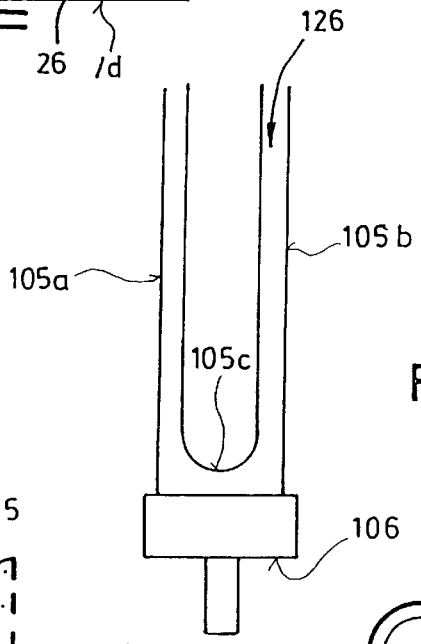

Another embodiment is illustrated in FIG. 10 where four layers of curtain web are provided. Two outer curtains 105*a*, 105*b* are again interconnected by a common end bar 106 which optionally prevents that fire protection material, which may be introduced from above (see the conveyor 111–113 of the previous embodiment), can fall down (or only in a controlled manner through outflow openings 117). Between the two outer curtain webs 105*a,* 105*b,* this embodiment shows a double curtain web 105*c* forming a loop. Also into this loop, fire-proof or fire resistant material may be filled (either in addition to filling the outer space 126 defined by the curtains 105*a* and 105*b* or alternatively to that) in the manner discussed above. Unwinding and supporting the coils of the curtains 105*a* to 105*c* may be effected according to one of the arrangements discussed previously. It is not even necessary to provide two separate curtains 105*a,* 105*b,* for the end bar could have deflection rollers at its upper side (or in its interior) through which a loop of the web forming the curtain 105*a* is drawn up as the curtain 105*b*. Likewise, four (or another number) of separate curtains may be provided which may optionally have different properties (reflecting, a melting coating etc.).

Figure 11:
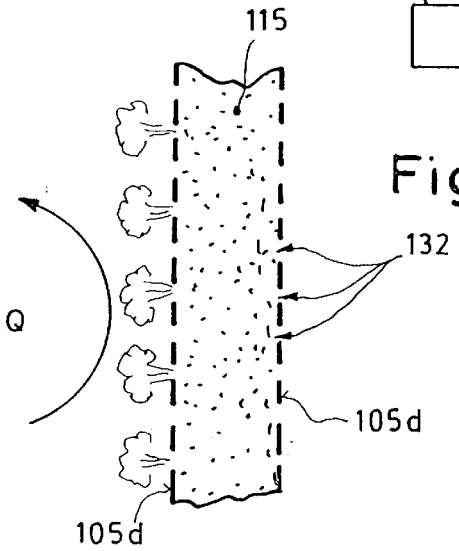
FIG. 11 shows a preferred design of a curtain.

Given the above-mentioned preconditions, a fire protection layer 115 between two curtains 105*d* (comprising either a loop or not) may preferably be formed in accordance with FIG. 11. It should be understood that also in this embodiment the application of a moveable support for the upper end of the curtain or the common end bar as well as the guide bars are of advantage, but that this embodiment has inventive character for its own. To wit, if the curtain 105*d* is provided with a number of openings 132, which are preferably evenly distributed over at least part of its surface, these openings may be used to blow out a cooling gas forming a protective and isolating boundary layer to increase the endurance of the fire protection shutter in case of a blaze. The openings 132, in the simplest case, are formed by the pores of a woven fabric, e.g. of a plain woven fabric or even a sateen fabric or any other porous curtain web. Also use of a-jour weave having spaced holes may be favorable.

The inner fire protection layer 115 may be formed from a special additive which dissociates or transforms to a cooling (in comparison to the temperature of a blaze) gas or may even consist only of it. The simplest example for producing such a gas is water which transforms into steam under the heat of fire, thus fixing the temperature of the fire protection curtain to 100° C. for a certain time. Water may be supplied via the conveying line 111 mentioned above and through spraying nozzles corresponding to openings 113.

In order to ensure uniform delivery of water steam, it is advantageous (just in the case of a curtain consisting of the two webs shown as well as of the inner layer of sufficient flexibility to be wound up provided therebetween) if the inner fire protection layer 115 consists of a fire-proof or fire resistant mineral foam which contains a gas used for foaming which is ordinarily air. When producing the foam, the gas is removed from the pores by introducing the porous foam into an air-tight chamber after which a vacuum is applied. Subsequently, water is introduced into the chamber, and pressure is normalized again so that the pores of the foam will suck the water off.

It is advantageous to take measures to ensure that the watery contents of the foam remains in place and to prevent escape. To this end, the water containing material may be enveloped with a protective mass, for example with a material melting under elevated temperatures, thus dissipating heat, and/or with a gel. This can be done by adding a gel or a dispersion of plastic material to the liquid, i.e. generally water, optionally with additives, at the end of sucking into the pores of the foam, allowing it to deposit. Alternatively, depositing is effected by a precipitating reaction, as is known to those skilled in chemical processes.

Of the additives, again zinc oxalate should be mentioned (which, due its bad solubility in water may easily applied together with water) or such substances which, for example contain bound water, and which may be used in addition or alternatively to the foam mentioned above. Examples include mineral foams having a high degree of water of crystallization, zeolites, lycopodium spores and/or hydrogel. Additives may also be introduced into water, such as the above-mentioned antifreezing or corrosion-proofing agents. Such additives are particularly advantageous if the inner layer 115, as shown in FIGS. 8 to 10, is only introduced in case of a fire.

Figure 12:
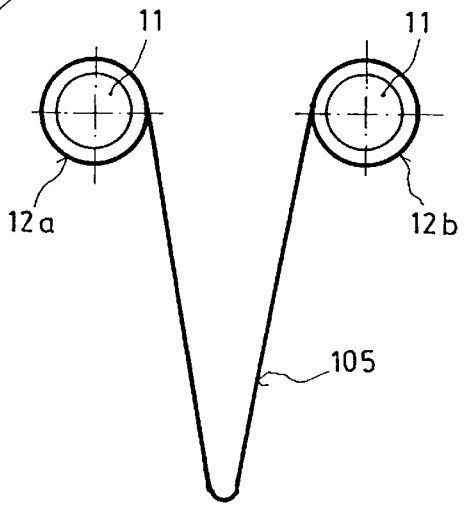
FIGS. 12 and 13 depict each a favorable embodiment, one in a lateral view, the other in a front view.

FIG. 12 illustrates an embodiment taking another effect into account which may be of particular effect with high fire protection shutters (see the hall of FIG. 1). It concerns the fact that the temperature in case of a blaze is much higher at top than at bottom. This means that the fire protection shutter will be subjected to a higher temperature stress at its upper side than at its bottom portion. This effect can be counteracted by broadening and reinforcing the fire protection shutter (curtain 105) towards to upper portion thereof. This measure can also be applied to fire protection shutters of rigid material, such as with plate-like shutters, roller blinds etc.; therefore, it constitutes a technical approach of inventive character for its own, although the use of a curtain in form of a loop is particularly preferred. The ratio of broadening in upward direction will, of course, depend upon the respective given conditions (e.g. height of the room, height of the fire protection shutter) as well as upon the actual hazards (e.g. presence of more or less hazardous materials etc.) or upon the requires quality of fire protection. In this connection, it will be clear that the interior of the loop shown in FIG. 12 may be filled with fire-proof or fire resistant material in the manner already described, for example also analogously to FIG. 10 by arranging the loop-shaped curtain 105*c* to extend only over the upper part of the height of the curtain 105 shown in FIG. 12.

Figure 13:
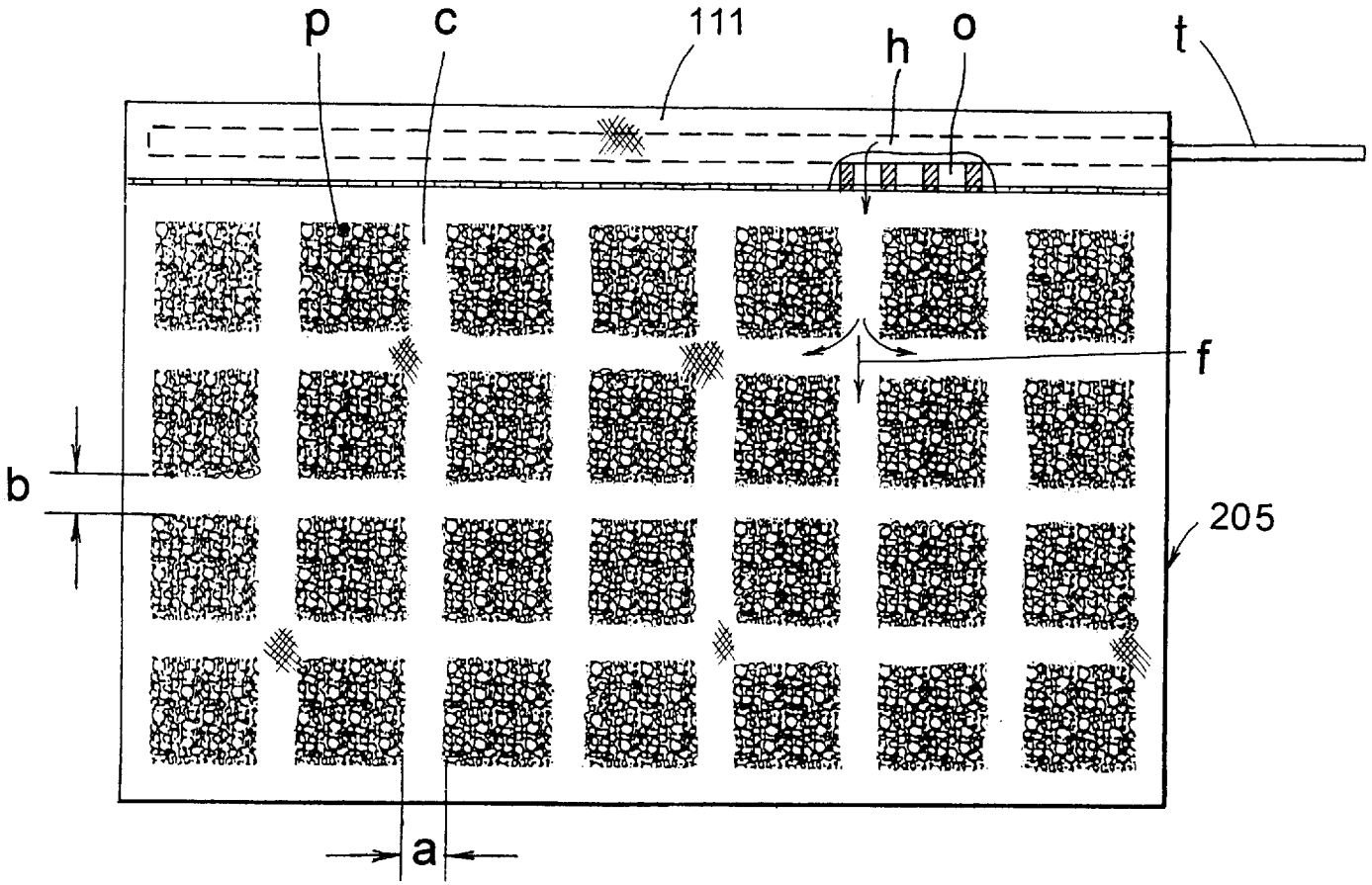

The front view of FIG. 13 shows a curtain 205 without the end bar or the guide bars which may be formed in the manner described above. The curtain 205 is represented in unwound condition from a coil core 111. This embodiment illustrates another kind of multilayer construction of the curtain 205, since this curtain has fleece pads arranged in directions perpendicular to each other and being spaced by distances a nad b, respectively. These pads p favorize the evaporation of any fire protection liquid supplied, such as water. The distances a and b may be equal or different, and the distances a can also broaden in upward direction in order to provide less resistance to the liquid supplied into the, thus, formed capillary channels c at top than below.

The fleece pads p may be applied, optionally being glued or stitched, e.g. in individual points, onto the outer surface of the clothing forming the channels c, thus constituting an outer layer. This may be effected on one side or on both sides of the curtain 205. Moreover, it is possible to weave a layer of sponge cloth into the fabric forming the channels c. A further possibility consists in forming a hollow clothing, the fleece pads or any other fiber layers favuourizing evaporation being inserted or woven into the cavities.

Supply of fire protection liquid is effected in this embodiment through a supply tubing t, for example, receiving water via a rotary joint known per se in engineering and not shown in FIG. 13. This tubing t is connected to a cylindrical cavity h extending over the whole coil core 111 from which discharge openings o depart for discharging the fire protection liquid supplied. The number of openings o is not critical, but it is favorable, if at least one opening o faces a capillary channel c over which the liquid id distributed in the direction of arrows f by gravity, on the one hand, and by capillary action, on the other hand. The diameter of the openings o can be increased with increasing distance from the tubing t in order to attain a more uniform distribution of the liquid over the length of the core 111.

Supplying water via the cavity h makes, of course, accommodation of a motor within the interior of the coil core 111 more difficult., though not impossible, since such a motor wight be accommodated in a lateral prolongation of the core 111 beyond the width of the curtain 205, or on the outside of the core. The water (or any other fire protection liquid) supplied will evaporate on the surface of the curtain 205 in the same manner as has been described above with reference to FIG. 11, thus, protecting the fabric which is permeable for the developing steam due to its pores. Also in this embodiment, a coating may be provided on the surface of the curtain, which melts in case of a fire, thus, dissipating heat, and freeing the pores of the fabric only after having molten. Another possibility is to form a surface of the curtain 205 which is gas permeable, but locks any liquid. It is to be understood that the supply of a fire protection liquid via the coil core, on the one hand, and the provision of a multilayered integral curtain contains inventive characteristics being independent from the other characteristics described in this specification.

Although the present invention has mainly been described with reference to fume or fire protection shutters to be moved in a vertical plane up and down, it has to be understood that they may optionally be used in vertical shafts, e.g. of a vertical conveyor, where the curtain will then extend in a substantially horizontal plane.

What is claimed is:

1. A curtain arrangement comprising:

at least one web of temperature resistant material having two opposite web surfaces and lateral edge regions on either side of the web, said web being adapted to be wound onto and unwound from a coil;

at least one core winding said at least one web to form said coil, said core having two axially spaced ends;

guide and holding means for said web including a bearing arrangement having at least one substantially stationary supporting surface beneath said core and the respective coil so as to allow the coil to rest on it, and guide means for providing guided vertical movement of said core and coil upon unwinding from a fully wound position, said guide means including end bar means forming a weight for said web to guide it up and down under its weight, said end bar having a wedge-like top surface:

casing means for housing said core and said bearing means, said casing means including slot-like outlet means for the curtain, said wedge-like top surface closing said slot-like outlet means in said fully wound position of said web.

2. Curtain arrangement as claimed in claim 1, comprising at least two webs are coiled in common on said coil core, said bearing arrangement comprising at least one of said substantially stationary supporting surfaces between said axially spaced ends as an intermediate bearing means.

3. Curtain arrangement as claimed in claim 1, wherein said bearing arrangement comprises at least two supporting rollers parallel to each other.

4. Curtain arrangement as claimed in claim 1, wherein said bearing arrangement comprises propping means arranged at one of said axially spaced ends, said coil core elastically propping against said propping means.

5. Curtain arrangement as claimed in claim 4, further comprising drive means to move said curtain in a vertical direction, said drive means being arranged on at least one of said axially spaced ends, said propping means being disposed at said one of said axially spaced ends.

6. Curtain arrangement as claimed in claim 1, wherein said bearing arrangement is provided at one edge region of said web.

7. Curtain arrangement as claimed in claim 1, wherein said edge regions are thickened, said at least one coil core having a smaller diameter at the respective thickened edge region.

8. Curtain arrangement as claimed in claim 1, wherein said at least one coil core comprises at least two substantially uniform modules and connecting means interconnecting said modules in an axial direction.

9. Curtain arrangement as claimed in claim 1 wherein said guide bar comprises a box section having an open surface, the open surface of said box section forming said slot.

10. An end bar for a curtain arrangement, comprising:

a pair of elongated clamping bar legs extending in part parallel to and opposite to one another, each of said bar legs being provided at one end with a flange or connection cross-piece extending towards the other bar leg, whereas the opposite end of each bar leg has a clamping surface, the clamping surface of both bar legs being substantially parallel in a clamping position of said bar legs, an inclined wall portion being provided on each of said bar legs between said flange or connection cross-piece and said clamping surface, the inclined wall portions of both bar legs converging towards said clamping surfaces;

a clamp piece between said bar legs to receive an end portion of said curtain arrangement wrapped around it and frictionally held by said inclined wall portions when engaging them under the weight of said bar legs; and clamping means engageable with the flanges or connection-cross-pieces for interconnecting the bar legs and clamping said clamping surfaces together.

11. End bar as claimed in claim 10, wherein said clamping surfaces are substantially smooth.

12. End bar as claimed in claim 10, wherein said connection cross-pieces overlap each other.

13. End bar as claimed in claim 10, wherein at least one of said bar legs comprises an oblique surface between the respective connection cross-piece and the respective clamping surface, said oblique surface being inclined under an angle with respect to a center plane extending between the clamping surfaces of the two bar legs, the end bar further comprising a clamp piece, which is inserted between the two legs to engage said oblique surface and to provoke a wedge effect onto a curtain inserted therebetween.

14. An end bar for a curtain arrangement, comprising:

a pair of elongated clamping bar legs having two lateral ends opposite to one another, one end of which including a connection cross-piece, whereas the opposite end of each leg has a clamping surface, the clamping surfaces of both legs being substantially parallel in clamping position, wherein each of said elongated bar legs consists of at least two parts interconnected in a longitudinal direction as individual, substantially uniform modules, the modules of one bar leg overlapping the modules of the other bar leg in longitudinal direction to reinforce said end bar; and clamping means for clamping said clamping surfaces together.

15. A curtain arrangement comprising:

a plurality of webs of temperature resistant material, each of said webs having two opposite web surfaces and thickened lateral edge regions on either side of the respective web, said webs being joined to one another along said thickened lateral edge regions, said webs being adapted to be wound onto and unwound from a coil, said coil having thickened regions formed by a winding of said edge regions;

at least one core winding said webs to form said coil, said core having two axially spaced ends;

guide and holding means for said webs including a plurality of bearing arrangements each having at least one supporting surface disposed beneath said core and in engagement with one of said thickened regions of said coil so as to allow the coil to rest on said supporting surface, said guide and holding means further including guide means for providing guided vertical movement of said core and said coil upon unwinding.

16. Curtain arrangement as claimed in claim 15 wherein said bearing arrangement includes at least two supporting rollers parallel to each other.

17. A curtain arrangement comprising:

at least one web of temperature resistant material having two opposite web surfaces and lateral edge regions on either side of the web, said web being adapted to be wound onto and unwound from a coil;

at least one core winding said at least one web to form said coil, said core having two axially spaced ends;

drive means to move said curtain in a vertical direction, said drive means being arranged on one of said axially spaced ends of said core and exerting a gravitational force on the end by its own weight;

guide and holding means for said web including a bearing arrangement having at least one substantially stationary supporting surface beneath said core and the respective coil so as to allow the coil to rest on said supporting surface, said guide and holding means further including guide means for providing guided vertical movement of said core and coil upon unwinding, said bearing arrangement including elastic propping means arranged at one of said axially spaced ends for exerting a vertically upward force on said core to support said core in opposition to a gravitational force.

18. Curtain arrangement as claimed in claim 17, further comprising drive means to move said curtain in a vertical direction, said drive means being arranged on at least one of said axially spaced ends, said propping means being disposed at said one of said axially spaced ends.

19. A curtain arrangement comprising:

a substantially enclosed casing, said casing having a slot;

at least one web of temperature resistant material having two opposite web surfaces and lateral edge regions on either side of the web, said web being adapted to be wound onto and unwound from a coil substantially surrounded by said casing, said web extending through said slot in an unwound configuration of said web on said core;

at least one core winding said web to form said coil, said core being disposed substantially within said casing and having two axially spaced ends;

guide and holding means for said web including a bearing arrangement disposed in said casing and having at least one substantially stationary supporting surface beneath said core and the respective coil so as to allow the coil to rest on said supporting surface, said guide and holding means further including guide means disposed in said casing for providing guided vertical movement of said core and coil upon unwinding; and an end bar clamped to a lower edge of said web, said end bar substantially closing said slot in a wound configuration of said web on said core.

* * * * *